United States Patent [19]

Vehling

[11] Patent Number: 4,723,721

[45] Date of Patent: Feb. 9, 1988

[54] WINDING MACHINE

[75] Inventor: Ernst Vehling, Bordesholm, Fed. Rep. of Germany

[73] Assignee: Neumuenstersche Maschinen-und Apparatebau GmbH (NEUMAG), Neumuenster, Fed. Rep. of Germany

[21] Appl. No.: 938,054

[22] Filed: Nov. 17, 1986

[30] Foreign Application Priority Data

Dec. 10, 1985 [DE] Fed. Rep. of Germany ..... 3543565

[51] Int. Cl.[4] ..... B65H 54/20; B65H 54/32

[52] U.S. Cl. ..... 242/35.5 R; 242/43 A; 242/43.1; 242/158 B

[58] Field of Search ..... 242/35.5 R, 43 R, 43 A, 242/43.1, 158 B

[56] References Cited

U.S. PATENT DOCUMENTS

| | | | |
|---|---|---|---|
| 1,170,212 | 2/1916 | Allen et al. | 242/158 B X |
| 1,239,669 | 9/1917 | Colman | 242/158 B X |
| 2,238,128 | 4/1941 | Nydegger | 242/43 A |
| 3,333,782 | 8/1967 | Beckwith, Jr. | 242/43 A |

FOREIGN PATENT DOCUMENTS

| | | | |
|---|---|---|---|
| 1535091 | 2/1970 | Fed. Rep. of Germany . | |
| 2310202 | 9/1974 | Fed. Rep. of Germany . | |
| 2622243 | 12/1977 | Fed. Rep. of Germany | 242/43 A |
| 139975 | 8/1983 | Japan | 242/43 A |
| 1024639 | 3/1966 | United Kingdom | 242/158 B |

*Primary Examiner*—Stanley N. Gilreath
*Attorney, Agent, or Firm*—Michael J. Striker

[57] ABSTRACT

A winding machine, comprises a machine frame, a winding mandrel which is connected with the machine frame during winding, traversing device including two belt runs movable near one another in opposite directions and provided with drivers, diverters each arranged at a respective one of reversing points of the traversing device and displaceable parallel to a winding axis, a sensing element abutting against a surface of a coil which is being wound, and a transmitting device which couples the diverters with the sensing element, the transmitting device including at least one displacing rod which connects the diverters with one another and extends parallel to the winding axis, a guiding rail with which the displacing rod is in engagement, the guiding rail and the traversing device being formed so that they are displaceable in correspondence with movement of the sensing element relative to one another at a right angle relative to the winding axis.

11 Claims, 7 Drawing Figures

WINDING MACHINE

BACKGROUND OF THE INVENTION

The present invention relates to a winding machine, and more particularly to such a winding machine which has a winding mandrel immovably retained on a machine frame during winding, and a traversing mechanism.

Winding machines are known for coiling with extremely high yarn speeds, for example 6000 m per minute. In these machines the yarns are reciprocably guided by drivers which are mounted on two oppositely movable band or belt runs. The alternating movement of the yarns is performed here not by a conventional traversing mechanism with a single reciprocably movable yarn guide, but instead by oppositely movable drivers which alternatingly engage and guide the yarns. Since the drivers are neither accelerated nor decelerated at the reversing point of the yarn, the influence of the mass of the yarn guiding elements during the yarn reverse is completely excluded.

With the respective shape of the drivers or relative arrangement of the belt runs, the yarns are released from a driver and simultaneously taken by another driver. The reverse point lies at the location at which the drivers meet. When it is desired to achieve a spool formation with flat and exact end faces, the reverse points must lie exactly at the same locations. Irregular deviations which lie in the dimensions of the thickness of a yarn cause an inaccurate edge formation. A so-called transverse strike takes place, or in other words short yarn pieces run as chords over the edge of the winding. It is therefore necessary to synchronize carefully the movement of the drivers.

Many winding machines are provided with two rotatable belts or bands equipped with drivers. The bands are arranged so that one run of a band is located very close to the run of the other band movable in an opposite direction. In these machines the above mentioned synchronization problems are especially pronounced because partially of a different expansion of the belts or bands as a result of different material properties or because different aging.

Winding machines are also known which include only one rotatable element with opposite runs approaching one another via deviating rollers. While material-caused inaccuracies are excluded here, the above mentioned transverse strike is not completely eliminated. It is also known to arrange fixed diverters at the end of the changing region so that the yarns are always released exactly at the same locations of the incoming drivers.

The above mentioned features are disclosed in the German document DE-OS No. 1,535,091, in which the diverters are arranged differently so that the transversing stroke during the winding process is shortened with increasing coil diameter. The nominal reversing point travels from one coil location to another coil location inwardly when the actual reversing point of one coil location, determined by respective disturbance influence, lies at one side of the nominal reversing point, the yarn nevertheless does not slide from the edge since the position which lies hereinbelow is somewhat wider. The coil obtains conical or curved end surfaces. With a sufficiently great cone angle, the occurrence of transverse strike can be suppressed.

In the winding machine disclosed in the German document DE-OS No. 2,622,243 from which the present invention is initiated, the displacement of the diverters is coupled by a transmission with the position of a sensing element which abuts against the peripheral surface of the coil and deviates in correspondence with the increasing coil diameter. The transmission here includes only a locking gripper-type linkage which must be actuated via a not-described lever device. The exact operation of it is not explained in detail, and it cannot be ascertained whether this device is suitable for winding machines in which a plurality of winding 15 locations arranged in series with one another are associated with a single winding mandrel. This latter consideration is especially important. During winding of thin yarns with extremely high speeds, it is important for avoiding excessive coil weight when up to eight coils are arranged on a winding mandrel.

SUMMARY OF THE INVENTION

Accordingly, it is an object of the present invention to provide a winding machine which avoids the disadvantages of the prior art.

More particularly, it is an object of the present invention to provide a winding machine which has a simple and exact control of a transversing stroke in dependence upon increasing diameter of a spool, for simultaneous winding of several neighboring coils and for easy conversion to another number of winding locations.

In keeping with these objects and with others which will become apparent hereinafter, one feature of the present invention resides, briefly stated, in a winding machine which has transmitting means for coupling the diverters with a sensing element abutting against the surface of the coil and including at least one displacing rod which connects both diverters with one another and extends parallel to a winding axle, the displacing rod is engagement with a guiding rail, and traversing means and the guiding rail are displaceable, in correspondence with the deviation of the sensing element, relative to one another at right angle to the winding axis.

When the winding machine is designed in accordance with these features, a wedge or cam transmission has the guiding rail producing the end surfaces of the coil. A special advantage is that the shape and position of the guiding rail can be directly adjusted to the shape of the end surfaces.

There is a possibility to control both diverters of a winding location by the transmitting means separately and independently from one another.

In accordance with a further feature of the present invention, the second diverter is connected with a second parallel displacing rod which is coupled with the first mentioned displacing rod in opposite directions. Both displacing rods are provided at their sides which face toward one another, with a plurality of teeth which engage with a gear arranged therebetween. These features provide for concrete structural embodiments in which by selection of a single guiding rail, an exact mirror-diametrical coil shape is achieved.

A further feature of the present invention is that the respective diverter is formed as a plurality of diverters arranged in series near one another at respective coil [winding] locations and attached to a respective one of the displacing rods. In this construction all diverters at all winding locations are removed synchronously by a single transmission. Here it does not play any role whether the individual winding locations have separate traversing bands or the traversing band runs extend over several winding locations.

In accordance with a further advantageous embodiment, the diverters are formed as lateral projections of strips which are connected with the displacing rods and extend between the belt runs over the entire length of all winding locations. The strips with the diverters have the advantage that for conversion to another number of winding locations, they are easily exchangeable. They also serve the purpose of guiding the runs near one another and holding them separately.

For separation of both runs it is especially important when in accordance with a further feature of the present invention both belt runs are formed as runs of a single toothed rim, and the runs approach one another over deviating disks.

It is also important when the sensing element is formed as a sensing roller for the coil, the guiding rail is connected with the machine frame, and the driving roll is supported in a housing of the traversing mechanism.

In accordance with advantageous embodiments of the invention, the guiding rail is arranged turnably and arrestably in different winding positions. The guiding rail is also formed exchangeable.

The displacing rod is pressed by a pressure spring against the guiding rail. In this case a play-free and therefore exact movement of the displacing rod is provided.

Finally, the guiding rail has an end which is in engagement with the displacing rod, and the sensing roller is provided at said end. This reduces friction and wear of the respective elements.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
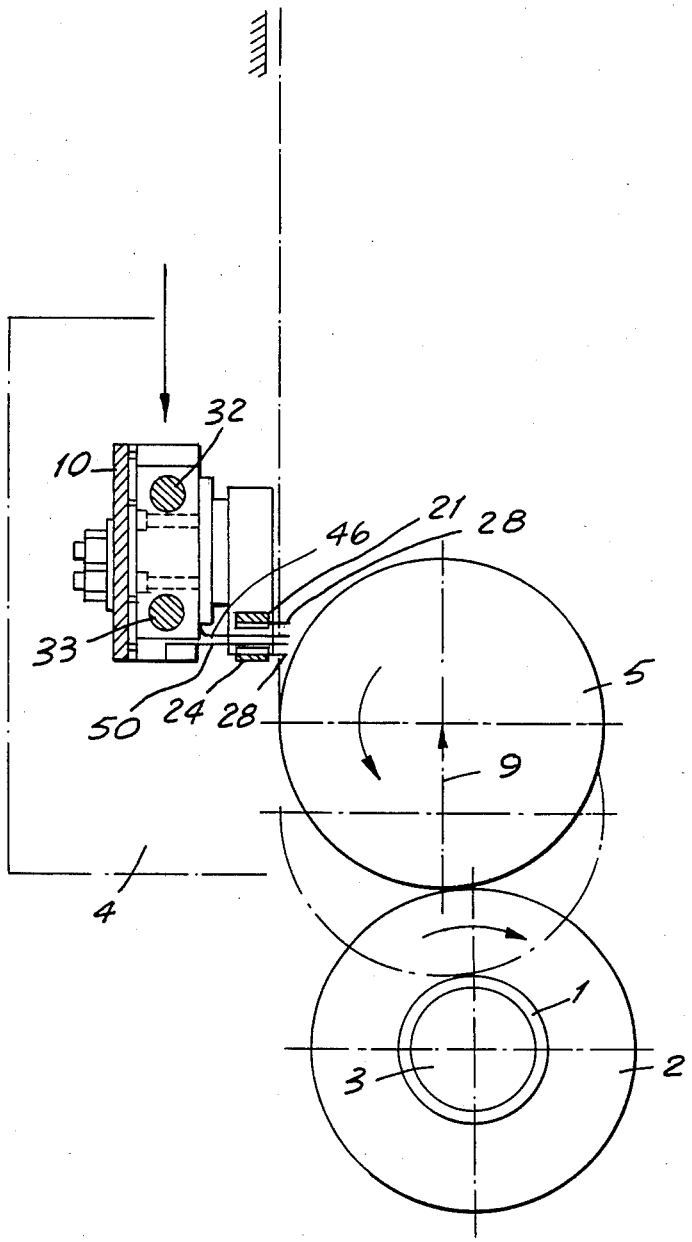
FIG. 1 is a view showing schematically a winding machine in accordance with the present invention, partially in section, and from one side.
Figure 2:
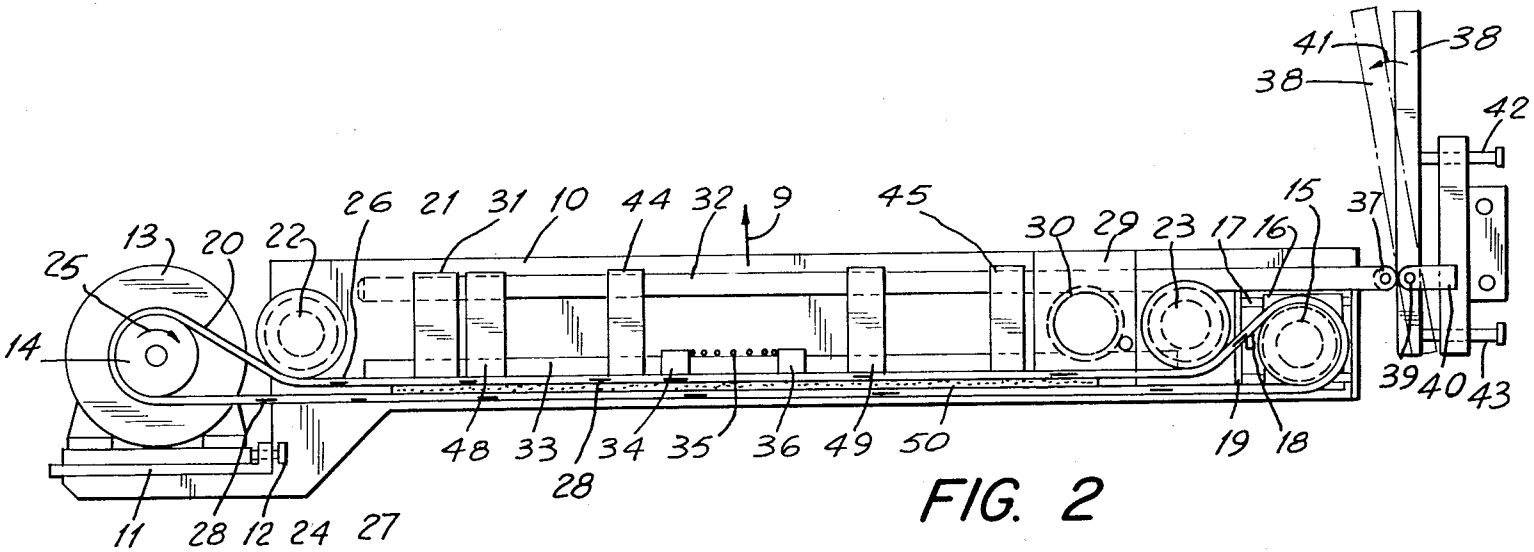
FIG. 2 is a view showing a traversing mechanism.
Figure 2A:
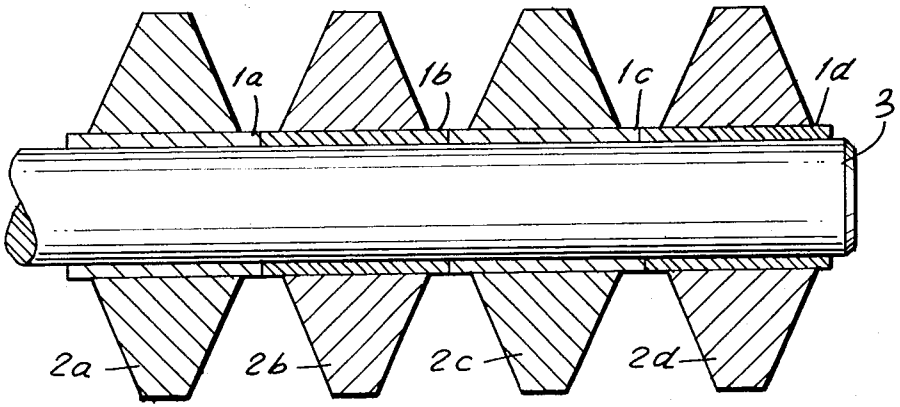
FIG. 2*a* shows in section the shape and arrangement of a coil.

A winding machine in accordance with the present invention will now be described in detail hereinbelow. FIG. 1 shows a sleeve 1 with a coil 2 on a winding mandrel 3. As will be explained later on, the winding machine has four winding locations arranged one near the other in series. In other words, four sleeves with four coils are arranged on the mandrel 3. The winding mandrel 3 is connected with a not-shown machine frame so that during formation of the coil 2 its position relative to the machine frame does not change. It can be seated for example on a revolving head.

Reference numeral 4 identifies a schematically shown housing. It is arranged reciprocably relative to the machine frame in a vertical guide. A driving roller 5 is supported in the housing 4 and is driven by a not-shown motor. A traversing device 6 is arranged in the housing 4 close to the driving roller 5. The driving roller 5 forms a sensing element.

A yarn guide 7 is connected immovably with the machine frame. The yarn guide 7 is arranged in correspondence with the number of the winding locations, respectively centrally over the associated winding location. Threads 8 are guided with high speed to the traversing device 6, pass a short free path portion, lie finally on an arc of approximately more than 90° on the outer surface of the driver roller 5, and reach the coil 2. In correspondence with the increasing coil diameter, the driving roller 5 deviates together with the traversing device 6 upwardly, as is symbolically shown by the arrow 9.

The traversing device 6 is associated in the housing 4 with a traverse 10. A plate 11 is welded to the traverse 10 and supports a motor 13 with a toothed drive disk 14. The motor 13 is adjustable in the longitudinal direction of the traverse 10 by means of an adjusting screw 12. A toothed deviating disk 15 is supported on a carriage at the other end of the traverse 10.

An endless toothed belt 20 is guided over the drive disk 10 and the deviating disk 15. An upper run 21 of the toothed belt 20 is guided over two further toothed disks 22 and 23 which are supported in the vicinity of the drive disk 14 or deviating disk 15. The upper run 21 is guided so that it runs parallel to a lower run 24 at a short distance therefrom. In the event of rotation of the drive disk 14 in a rotary direction identified by the arrow 25, the upper run 21 moves in the direction of the arrow 26, while the lower 24 moves in the opposite direction in accordance with the arrow 27.

The toothed belt 20 has an edge which faces away of the traverse 10. A plurality of drivers 28 are mounted on the above edge of the toothed belt 20. The drivers 28 are spaced from one another by uniform distances.

A bearing housing 29 is mounted over the upper run 21 on the traverse 10 closely near the toothed disk 24. A gear 30 with a horizontally extending axis is supported in the bearing housing 29. A guiding block 31 is mounted on the other side of the traverse 10 near the toothed disk 22 which is close to the motor 13. An upper displacing rod 32 and a lower displacing rod 33 are slidingly guided in openings of the guiding block 31 and the bearing housing 29 parallel to one another and also parallel to both runs 21 and 24 of the toothed belt 20. Both displacing rods 32 and 33 are provided in the region of the bearing 29 with teeth at opposite sides. The teeth of the displacing rods 32 and 33 engage with the gear 30 at locations which are offset from one another by 180°.

A bush 34 is fixedly arranged on the lower displacing rod 33. A pressure spring 35 supported in an abutment 36 presses the bush 34 and thereby the lower displacing rod 33 in direction to the motor 13. As a result of opposite coupling acting by the gear 30, the upper displacing rod 32 is pressed in the opposite direction which in the drawing is the direction to the right. The upper displacing rod 32 extends outwardly beyond the end of the traverse 10 at the side at which the deviating disk 15 is arranged. A sensing roller 37 is provided at the end of the extension of the displacing rod 32. Under the pressure applied by a spring 35, the sensing roller 37 abuts in a play-free manner against a guiding rail 38.

The guiding rail 38 is arranged turnably about a pivot pin 39 which is seated in a fork 40 welded to the machine frame. In the basic position shown in the solid lines, the guiding rail 38 is arranged vertically, or in other words at a right angle to the direction of the runs 21 and 24 and therefore at right angle to the winding axis. It is turnable from this position in the plane of the displacing rods 32 and 33, in the direction of the arrow 41 by an angle equal to approximately 30°. Within this angular region, it is arrestable by means of adjusting screw 42 and 43 in any position, for example as shown in broken lines and identified with reference numeral 38'.

Connecting pieces 44 and 45 are fixedly clamped on the upper displacing rod 32 and extend below to the height of the runs 21 and 24. A thin strip 46 is screwed thereon and lies flatly in the narrow intermediate space between the runs 21 and 24, so as to extend approximately over the entire free length between the toothed disks 22 and 23. The connecting pieces 44 and 45 are provided with openings for free sliding of the lower displacing rod 33. The strip 46 is provided at uniform distances with four diverters 47*a*–47*d* which are specifically shown in FIG. 3*a*. The diverters 47*a*–47*d* extend somewhat farther over the front edges of the toothed belt 20 provided with the drivers 28 than the drivers 28 themselves. The diverters 47 of the strip 46 are inclined in a wedge-shaped manner at the flank which faces toward the motor 13, or in the drawings to the left.

A strip 50 is connected respectively with the lower displacing rod 33 by connecting pieces 48 and 49 which are provided with openings for the sliding passage of the upper displacing rod 32. The strip 50 is located closely under the strip 46 and also between the runs 21 and 24. The strip 50 has four diverters 51*a*–51*d* which are arranged at the same distances from one another as the diverters 47 and provided with wedge-shaped inclines which, however, are located at the opposite side, the right side in the drawings. In the position which is shown in the drawings and can be readily recognized from FIG. 3*a*, the diverter 47*a* overlaps with the diverter 51*b*, the diverter 47*b* overlaps with the diverter 51*c*, and the diverter 47*c* overlaps with the diverter 51*d*, in particular with their wider sides.

Figure 4:
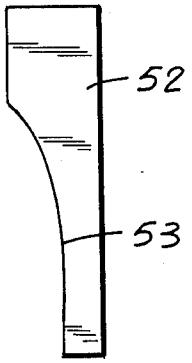
FIG. 4 is a view showing a different individual unit of the machine.
Figure 4A:
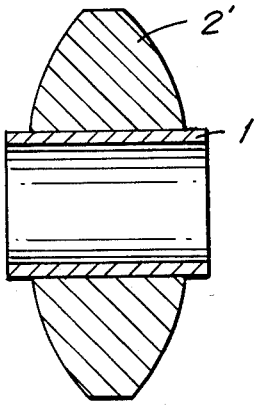
FIG. 4*a* is a view showing a coil with the shape corresponding to the unit of FIG. 4.

The turnable guiding rail 38 can also be provided with a curved guiding edge 53. This can be achieved by the provision of an easily exchangeable guiding element 52. In this case the coil 21 obtains curved end surfaces, as can be seen in FIG. 4*a*.

Figure 3:
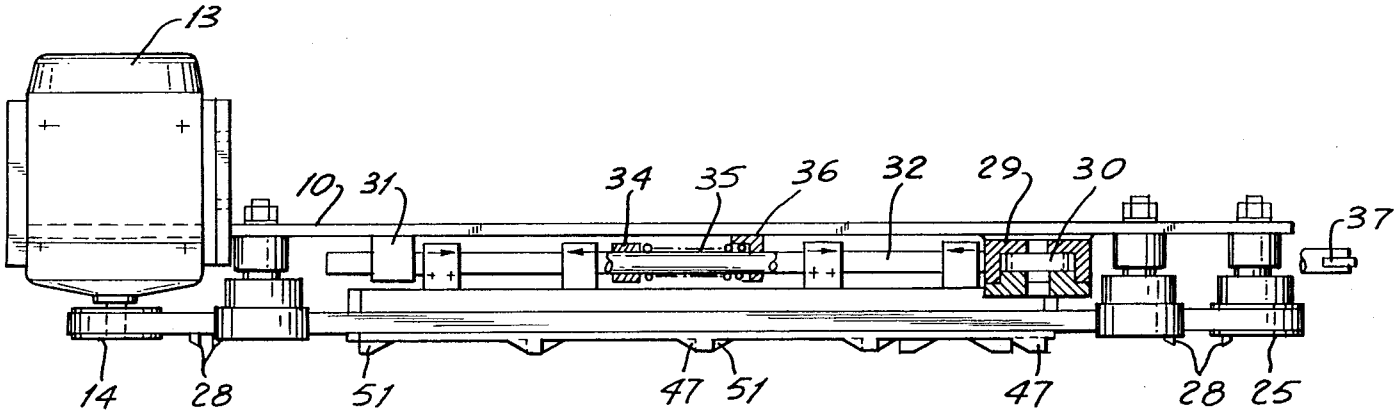
FIG. 3 is a view showing the traversing mechanism from above.
Figure 3A:
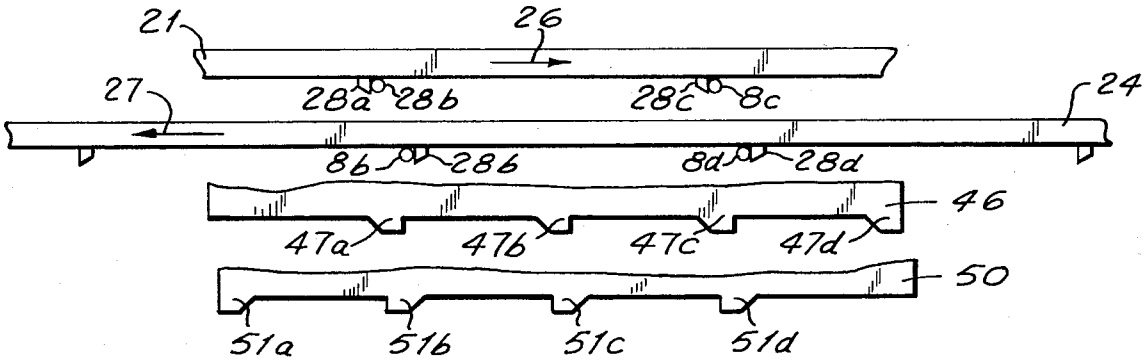
FIG. 3*a* is a view showing individual parts of the traversing mechanism from above, arranged near one another in a transverse direction.

The winding machine shown in the drawings runs all together four yarns 8*a*–8*d* as can be seen in FIG. 3*a*. The yarns 8*a* and 8*c* are moved by the drivers 28*a* and 28*c* of the upper run 21 to the right, while the yarns 8*b* and 8*d* are moved by the drivers 28*b* and 28*d* of the lower run 24 to the left in the drawings. In the shown position the yarns 8*a* and 8*c* are in contact with the wedge-shaped raising flanks of the diverters 47*a* and 47*c*. The yarns 8*b* and 8*d* are in contact with the oppositely includined flanks of the diverters 51*b* and 51*d*. The yarns 8*a* and 8*c* are located directly before the right reversing point of its traversing region, while the yarns 8*b* and 8*d* are located immediately before the left reversing point. In following moment all yarns are released by the diverters from the contact with the associated drivers and reverse their movement direction, because of the central arrangement of the yarn guide 7 over the associated angular locations. After their free movement, they are caught by respective drivers, and in particular the yarn 8*a* by the driver 28*d*, the yarn 8*b* by the driver 28*a*, the yarn 8*c* by the driver 28*d*, and the yarn 8*d* by the driver 28*c*. This process repeats respectively at the opposite reverse points of the individual traversing regions.

From the above presented explanation it is believed to be clear that the position of the reversing point is determined by the position of the diverter which releases the yarn reverse.

With increasing coil diameter, the traversing device 6 deviates, as described hereinabove, upwardly in the direction of the arrow 9. The sensing roller 37 moves on the guiding rail 38 which is fixedly connected with the machine frame and assumes, for example, the position 38'. As sensing roller 37 moves upwardly and displaces the displacing rod 32 to the left the displacing rod 33 moves forcedly to the right. The strips 46 and 50 with the diverters 47 and 51 displace with the displacing rods 32 and 33 by the same distance. The diverters 47*a* and 51*a* which determine the reverse points for the formation of the coil 2*a*, move with the increasing coil diameter toward one another similarly to the associated other pairs of diverters. The traversing stroke reduces, and the coil becomes conical. The cone of the coil exactly corresponds to the angular position of the guiding rail 38.

When the winding machine must be converted from four winding locations to eight correspondingly smaller winding locations, an operator exchanges the toothed belt 20 for another toothed belt which is provided over the same length with double number of drivers. Moreover, the strips 46 and 50 are exchanged for the strips with diverters which are arranged denser. The transmission for the automatic displacement of the diverters remains unchanged. The cone angle can be changed by simple adjustment of the guiding rail 38.

It will be understood that each of the elements described above, or two or more together, may also find a useful application in other types of constructions differing from the types described above.

While the invention has been illustrated and described as embodied in a winding machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A winding machine, comprising a machine frame; a winding mandrel which is connected with said machine frame during winding; traversing means including two belt runs movable near one another in opposite directions and provided with drivers, diverters each arranged at a respective one of reversing points of said traversing means and displaceable parallel to a winding axis, a sensing element abutting against a surface of a coil which is being wound and deviating during winding of the coil in response to a changing diameter of the coil being wound; and transmitting means which couple said diverters with said sensing element, said transmitting means including at least one displacing rod which connects said diverters with one another and extends parallel to said winding axis, a guiding rail with which said displacing rod is in engagement, said guiding rail and said traversing means being arranged to cooperate with said sensing element so that they are displaceable in correspondence with deviation of said sensing element during winding relative to one another at a right angle relative to said winding axis.

2. A winding machine as defined in claim 1, wherein said transmitting means includes a second displacing rod which is parallel to said first mentioned displacing rod and is coupled with the latter for opposite movement, said diverters including a second diverter which is connected with said displacing rods.

3. A winding machine as defined in claim 2, wherein said displacing rods have sides facing toward one another and are provided with a plurality of teeth at said sides; and further comprising a gear which is engaged with said teeth of said displacing rods.

4. A winding machine as defined in claim 2; and further comprising two groups of said diverters, the diverters of each group of said diverters being connected with a respective one of said displacing rods and arranged in series near one another at a plurality of winding locations.

5. A winding machine as defined in claim 4; and further comprising two strips each connected with a respective one of said displacing rods and extending between said belt runs over the entire length of all winding locations, said diverters being formed as lateral projections provided on said strips.

6. A winding machine as defined in claim 5, wherein said belt runs are formed as runs of a single toothed belt; and further comprising two deviating disks each arranged so that one of said runs approaches the other of said runs over said deviating disks.

7. A winding machine as defined in claim 1, wherein said sensing element is formed as a driver roller for a coil to be wound, said guiding rail being connected with said machine frame; and further comprising a housing for said traversing means, said driving roller being supported in said housing.

8. A winding machine as defined in claim 1, wherein said guiding rail is turnable and arrestable in different winding locations; and further comprising means for mounting said guiding rail so that it is turnable and arrestable in different winding locations.

9. A winding machine as defined in claim 1, wherein said guiding rail is exchangeable; and further comprising means for exchangeably mounting said guiding rail.

10. A winding machine as defined in claim 1; and further comprising a pressure spring arranged to press said displacing rod against said guiding rail.

11. A winding machine as defined in claim 1, wherein said displacing rod has an end which is in engagement with said guiding rail; and further comprising a sensing roller arranged on said end of said displacing rod.

* * * * *